US007067752B2

(12) United States Patent
Shin

(10) Patent No.: US 7,067,752 B2
(45) Date of Patent: Jun. 27, 2006

(54) SEESAW BUTTON OF HEATER CONTROL UNIT

(75) Inventor: Jun-Seong Shin, Yongin-si (KR)

(73) Assignee: Hyundai Autonet Co., Ltd., Incheon-si (KR)

( * ) Notice: Subject to any disclaimer, the term of this patent is extended or adjusted under 35 U.S.C. 154(b) by 0 days.

(21) Appl. No.: 10/975,440

(22) Filed: Oct. 29, 2004

(65) Prior Publication Data

US 2006/0016677 A1 Jan. 26, 2006

(30) Foreign Application Priority Data

Jul. 20, 2004 (KR) ..... 10-2004-0056389

(51) Int. Cl.
*H01H 9/00* (2006.01)

(52) U.S. Cl. ..... 200/310; 200/339; 200/313

(58) Field of Classification Search ..... 200/310, 200/313, 315, 512, 511, 339
See application file for complete search history.

(56) References Cited

U.S. PATENT DOCUMENTS 5,403,984 A * 4/1995 Ogawa ..... 200/517
5,850,062 A * 12/1998 Botz et al. ..... 200/315
6,605,790 B1 * 8/2003 Yoshida ..... 200/339

* cited by examiner

*Primary Examiner*—K. Lee
(74) *Attorney, Agent, or Firm*—Greenblum & Bernstein, P.L.C.

(57) ABSTRACT

The seesaw button of a heater control unit includes a guider formed with illumination holes corresponding to marking regions printed at the outer surface of a manipulation case with different colors, the guider being inserted into the manipulation case, a plurality of movable rods located at both sides of the guider to activate a contact switch of a substrate according to a manipulation of the manipulation casethe movable rods restoring the manipulation case to its original position when releasing the manipulation. The seesaw button further includes an accommodation housing that supports a middle portion of the guider coupled to the manipulation case, forms light inducing passages corresponding to the illumination holes and accommodates the movable rods and a plurality of prisms positioned at the light inducing passages that includes light emitted from light sources of the substrate toward the markings of the manipulation case.

4 Claims, 3 Drawing Sheets

SEESAW BUTTON OF HEATER CONTROL UNIT

CROSS-REFERENCE TO RELATED APPLICATIONS

The present application is based on, and claims priority from, Korean Application Serial Number 10-2004-0056389, filed on Jul. 20, 2004, the disclosure of which is hereby incorporated by reference herein in its entirety.

FIELD OF THE INVENTION

The present invention relates to a seesaw button of a heater control unit. More particularly, the present invention relates to a button adapted to use Light-Emitting Diode (LED) having identical or similar color to markings printed on the button and to induce each light of the LED to the markings by separating therebetween.

BACKGROUND OF THE INVENTION

Generally, an instrument panel is mounted in front of a driver and front passenger in a vehicle. The instrument panel typically contains gauges, audio system, air-conditioner unit, glove box, ashtray, various switches and the like and separates the engine room and passenger compartment.

The middle lower portion of the instrument panel is formed with a center panel containing a heater control unit. The heater control unit adjusts, in particular, raises the temperature of the passenger compartment, determines which outlets discharge the heated air, and controls the speed of the fan.

The heater control unit is typically manipulated by buttons. The buttons may be in a rotary switching type (rotating knobs to regulate the temperature and direction of the heated air), push-button type, seesaw type or the like.

In order to locate the heater control buttons during night driving, the buttons are conventionally printed with color markings on the surface thereof and equipped with a back light therein. The back light is preferably a Light-Emitting Diode (LED).

However, there is a drawback in the conventional heater control buttons in that although the marking colors and LED colors should match each other, the lights emitted from the LED (back light) blend in the buttons due to a lack of separation therebetween, thus deteriorating the clearness of the marking colors and marketability of the heater control buttons.

SUMMARY OF THE INVENTION

Embodiments of the present invention are provided to prevent a color blending of back light sources in a heater control button, wherein the light sources emit lights consistent in color with the markings (printed in different colors on the button) to allow a driver to be able to locate the button during night driving.

A seesaw button of a heater control unit comprises a guider formed with illumination holes corresponding to marking regions printed at the outer surface of a manipulation case with different colors. The guider is inserted into the manipulation case. Movable rods are located at both sides of the guider and activate a contact switch of a substrate according to the manipulation of the manipulation case and restore the manipulation case to its original position when releasing the above manipulation. An accommodation housing supports a middle portion of the guider coupled to the manipulation case and forms light inducing passages corresponding to the illumination holes. The accommodation housing accommodates the movable rods. Prisms are positioned at the above light inducing passages to induce light emitted from light sources of the substrate toward the marking regions of said manipulation case.

BRIEF DESCRIPTION OF THE DRAWINGS

For a better understanding of the nature and objects of the present invention, reference should be made to the following detailed description, read in conjunction with the accompanying drawings, in which.

DETAILED DESCRIPTION OF THE PREFERRED EMBODIMENTS

Figure 1:
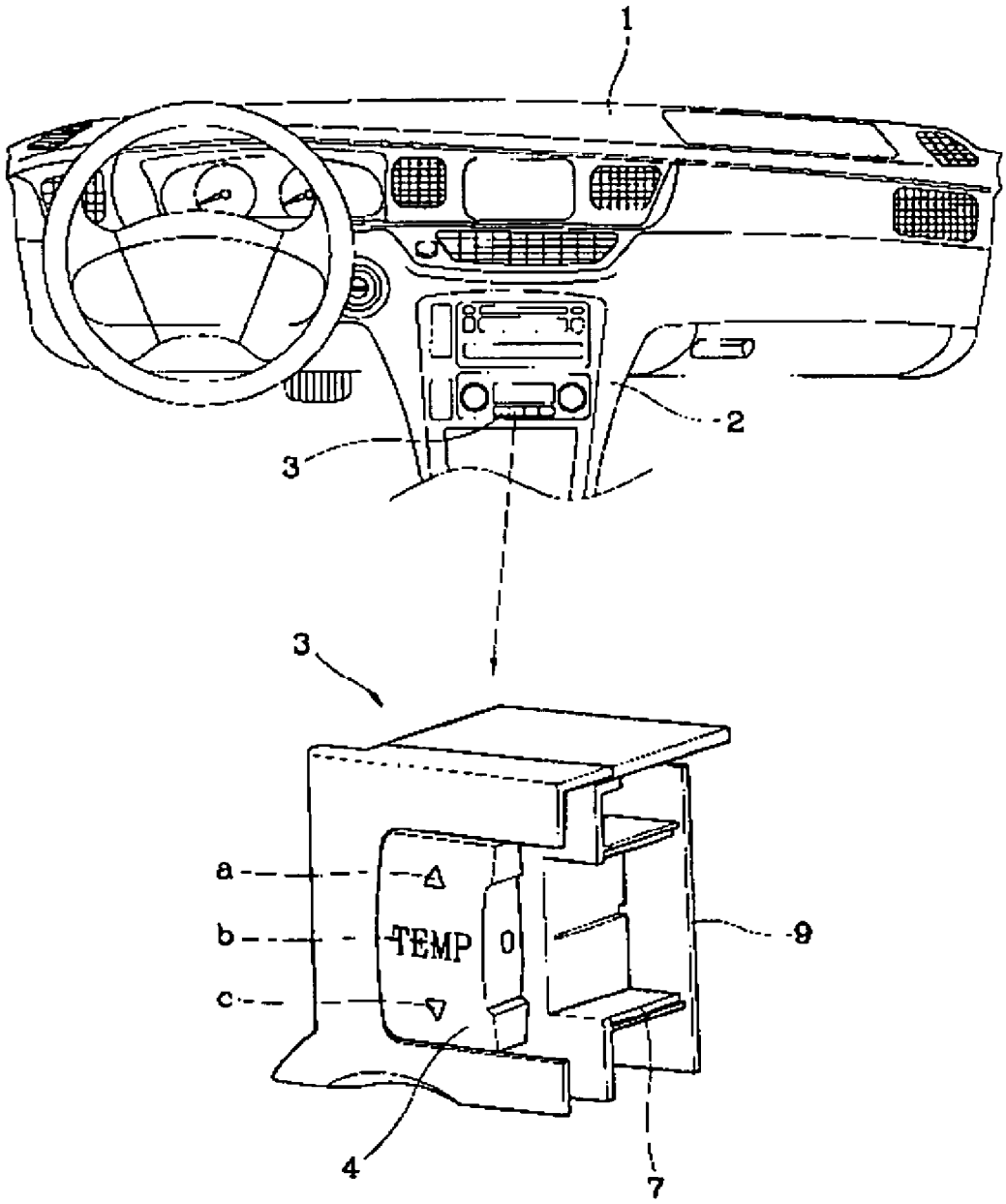
FIG. 1 is a schematic view of a seesaw button of a heater control unit according to an embodiment of the present invention.
Figure 2:
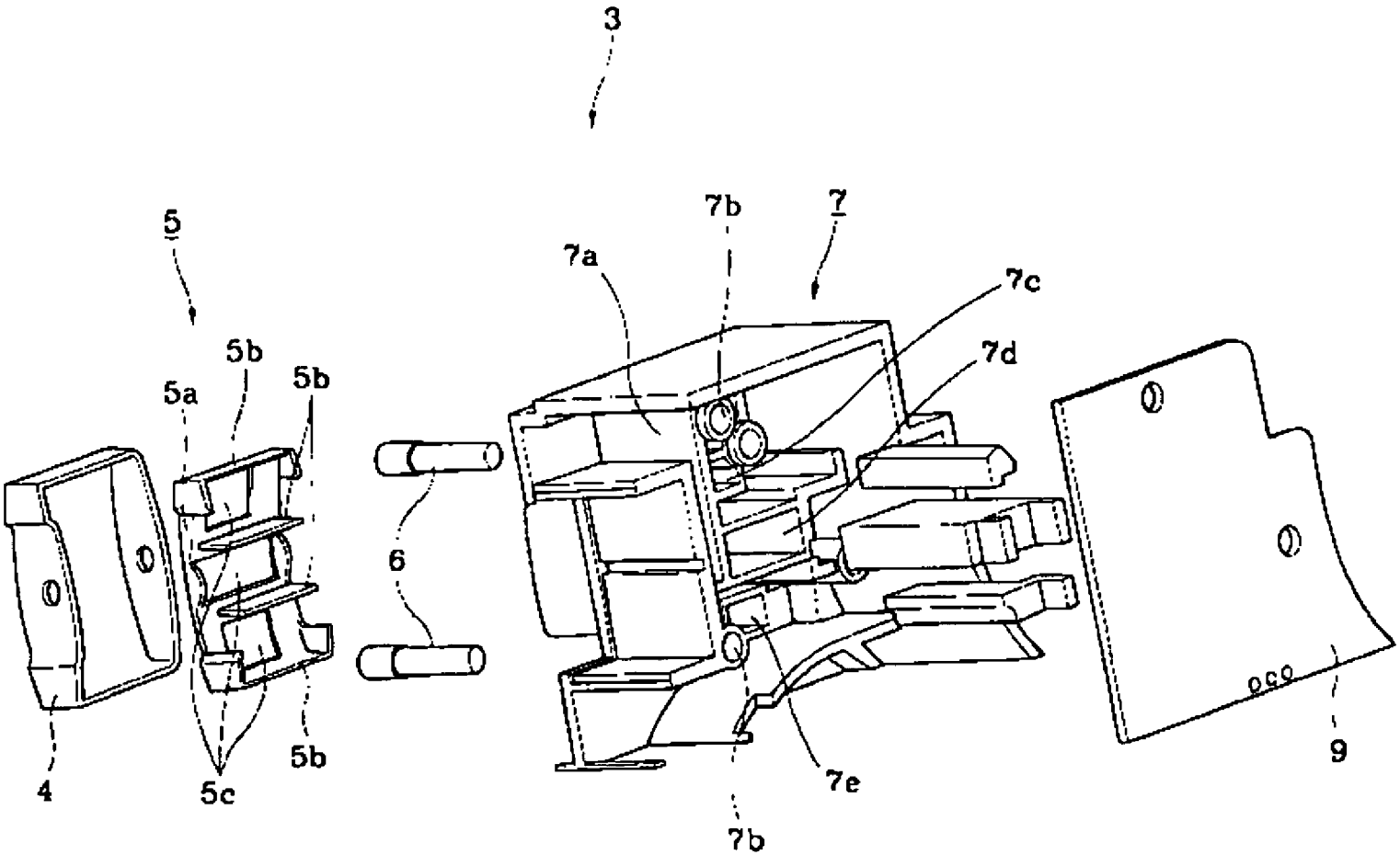
FIG. 2 is a perspective view of a disassembled seesaw button according to an embodiment of the present invention.

Referring to FIGS. 1 and 2, a plurality of seesaw buttons 3 are installed at a heater control unit 2 placed at a middle lower portion of an instrument panel 1. The seesaw button 3 includes a manipulation case 4 printed with markings (a, b, c) at the outer surface thereof with different colors to allow the manipulating disposition and function thereof to be more visible by the user. A guider 5 is formed with lateral flanges 5*b* and middle flanges 5*b*' that protrude out from a seesaw frame 5*a*. The seesaw frame 5*a* is inserted into the manipulation case 4 for support. The guider 5 forms illumination holes 5*c* corresponding to the above marking (a, b, c) regions. Movable rods 6 activate a contact switch of a substrate 9 during the seesaw-manipulation of the manipulation case 4. When releasing the above manipulation, the movable rods 6 restore the manipulation case 4 to its original position by using spring resilience. An accommodation housing 7 supports the middle flanges 5*b*' portion of the guider 5 to allow the seesaw movement of the manipulation case 4 and accommodates the movable rods 6. Prisms 8 are positioned at light inducing passages (d, e, f) formed at the accommodation housing 7 corresponding to the illumination holes 5*c* of the guider 5. The prisms 8 illuminate light emitted from light sources 10 of the substrate 9 toward the markings (a, b, c) of the manipulation case 4.

Figure 3:
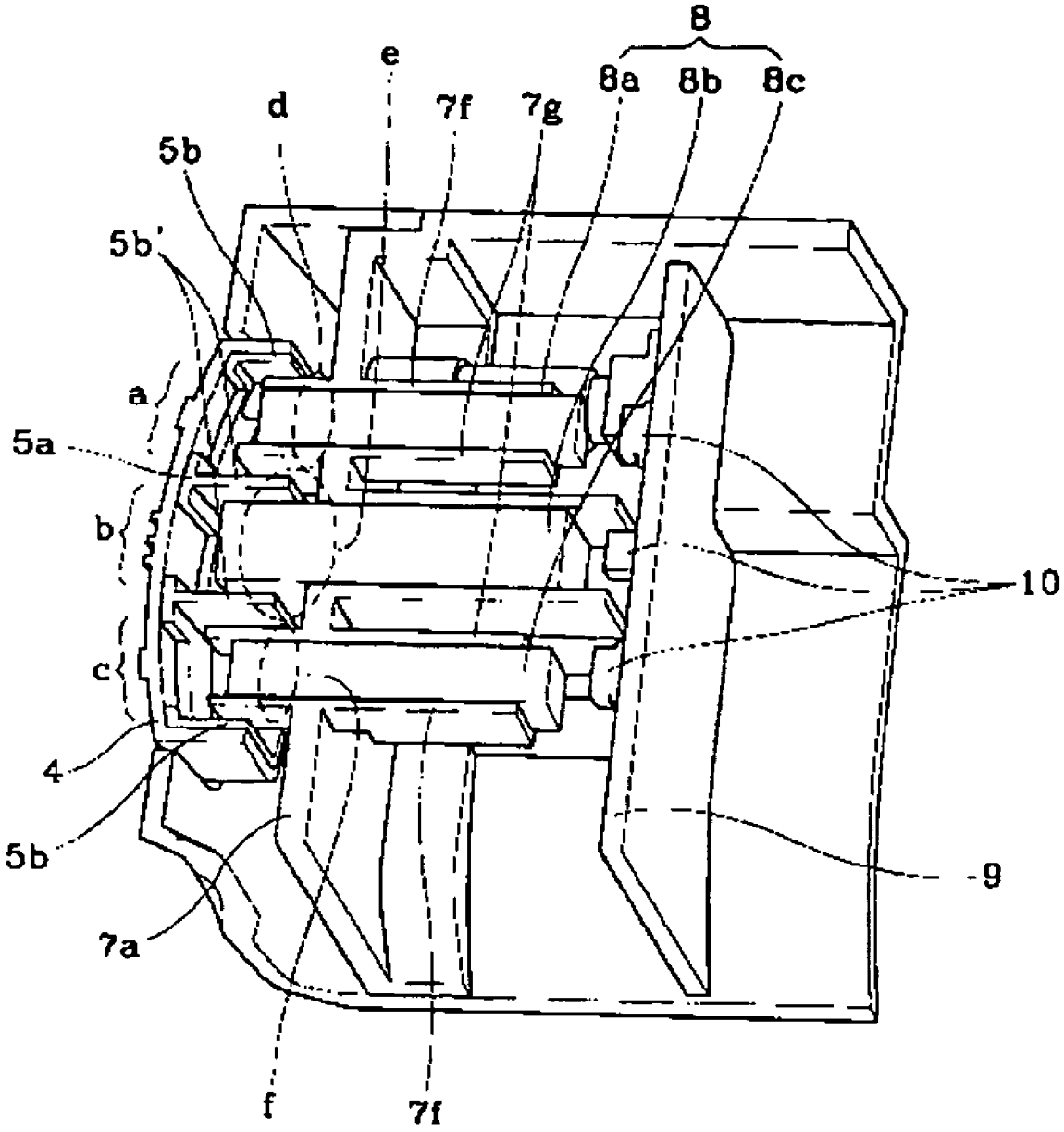
FIG. 3 is a cross-sectional view of an assembled seesaw button according to an embodiment of the present invention.

With reference to FIG. 3, the accommodation housing 7 includes a support wall 7*a* that separates the manipulation case 4 (coupled with the guider 5) and the substrate 9. Lateral flanges 7*f* and middle flanges 7*g* are formed at the support wall 7*a* to partition prism accommodation holes 7*c*, 7*d*, and 7*e*. The prism accommodation holes 7*c*, 7*d*, and 7*e* separately accommodate the prisms 8 disposed at each illumination hole 5*c* of the guider 5 to correspond to the markings (a, b, c) of the manipulating case 4. Guide holes 7*b* protrude from the support wall 7*a* toward the substrate 9 to accommodate the movable rods 6 that manipulates the contact switch set in the substrate 9 according to the teeter-totter movement of the manipulation case 4 and the guider 5.

The middle flanges 7*g* dividing the middle prism-accommodation hole 7*d* from the prism accommodation holes 7*c* and 7*e* (formed at both lateral sides of the accommodation housing 7) completely encloses the middle flange 5*b*' of the guider 5. The middle flange 7*g* also completely encloses a mid-light source that is installed at the substrate 9 in correspondence to the prism-accommodation hole 7*d*, thereby insulating light emitted from the light sources 10 through the prism accommodation holes 7*c* and 7*e*.

The prisms 8 are consistent in number to the markings (a, b, c) of the manipulation case 4. The prisms 8 are constituted by a first, second and third element 8*a*, 8*b*, and 8*c* placed at the prism accommodation holes 7*c*, 7*d*, 7*e* of the accommodation housing 7, respectively.

The light sources 10 are preferably a Light-Emitting Diode (LED) that emits colorful lighting identical to the markings of the manipulation case 4.

The assembly procedure and operation of the seesaw button 3 of the heater control unit 2 will now be described in detail with the accompanying drawings.

The accommodation housing 7 is placed at the light sources 10 portion installed on the substrate 9 formed with the power circuit. Then, the first, second, and third element 8*a*, 8*b*, and 8*c* of the prisms 8 are inserted into the prism accommodation holes 7*c*, 7*d*, 7*e*, respectively, wherein the prism accommodation holes 7*c*, 7*d*, 7*e* are formed via the lateral flanges 7*f* and middle flanges 7*g* protruding out from the support wall 7*a* of the accommodation housing 7, to thereby induce the light of the light sources 10 toward the manipulation case 4.

The movable rods 6 are inserted into the guiding holes 7*b* formed at the support wall 7*a* of the accommodation housing 7 to manipulate the switches mounted on the substrate 9.

Next, when the manipulation case 4 coupled to the guider 5 is inserted into the front portion of the accommodation housing 7 (i.e., with reference to FIG. 3, when the middle flanges 7*g* protruding out from the support wall 7*a* of the accommodation housing 7 accommodate the middle flanges 5*b*' formed at the seesaw frame 5*a* of the guider 5), the lateral flanges 5*b* of the guider 5 enclose the lateral flanges 7*f* that are formed at both lateral sides of the middle flanges 7*g*. Thus, the illumination holes 5*c* of the guider 5 corresponding to the marking (a, b, c) regions of the manipulation case 4 maintain the separated state thereof via the prism accommodation holes 7*c*, 7*d*, 7*e* of the accommodation housing 7.

As the seesaw button 3 of the heater control unit 2 is interconnected with an illumination device operated for lighting the instrument panel 1 and the like during nighttime driving, the manipulation case 4 of the seesaw button 3 illuminates by power provided to the heater control unit 2 via the interconnected electrical circuits.

The seesaw button 3 thus constructed completely prevents a color blending therein so as to distinctly illuminate each markings (a, b, c) printed in various colors on the exterior surface of the seesaw button 3. With reference to FIG. 3, if each light source 10 mounted on the substrate 9 emits light, then the lights are completely separated from each other via the lateral and middle flanges 7*f* and 7*g* of the accommodation housing 7 and delivered to the first, second and third element 8*a*, 8*b*, 8*c* of the prisms 8 accommodated at each prism accommodation hole 7*c*, 7*d*, 7*e*.

The first, second and third element 8*a*, 8*b*, 8*c* of the prisms 8 provided with lighting from the light sources 10 allow the lighting to be penetrated toward the manipulation case 4. The lighting penetrated at each first, second and third element 8*a*, 8*b*, 8*c* illuminate the manipulation case 4 through each illumination hole 5*c* of the guider 5.

The markings (a, b, c) printed in different colors on the surface of the manipulation case 4 give off light by receiving various colorful lights from the light sources 10. Accordingly, the markings (a, b, c) of the manipulation case 4 at the heater control unit 2 are clearly illuminated during night driving.

As apparent from the foregoing, there is an advantage in that the seesaw button contains markings with distinctive coloring, illuminates by being interconnected with a vehicle illumination device and receives lighting from light sources through the prisms, thereby preventing a mixture of light sources emitted from inside the seesaw button and improving the visibility of the instrument panel by the distinctive lighted buttons.

What is claimed is:

1. A seesaw button of a heater control unit, comprising:

a guider having illumination holes that correspond to markings printed at the outer surface of a manipulation case with different colors, said guider being inserted into said manipulation case;

a plurality of movable rods located at both sides of said guider to activate a contact switch of a substrate according to a manipulation of said manipulation case, said movable rods restoring said manipulation case to an original position thereof upon release of the manipulation;

an accommodation housing that supports a middle portion of said guider coupled to said manipulation case, said accommodation housing including light inducing passages corresponding to said illumination holes and accommodating said movable rods;

a plurality of prisms positioned at said light inducing passages that conduct light emitted from light sources of said substrate toward said markings of said manipulation case;

a support wall that separates said manipulation case, said support wall coupled with said guider and said substrate;

a plurality of lateral flanges and middle flanges provided at said support wall to partition prism accommodation holes, wherein said prism accommodation holes separately accommodate said prisms; and a plurality of guide holes protruding from said support wall toward said substrate to accommodate said movable rods that manipulate said contact switch of said substrate according to a teeter-totter movement of said manipulation case and said guider.

2. The button as defined in claim 1, wherein said middle flanges dividing a middle prism-accommodation hole from said prism accommodation holes provided at both lateral sides of said accommodation housing completely enclose said middle portions of said guider and completely enclose a mid-light source that is installed at said substrate in correspondence to said middle prism accommodation hole, thereby isolating the lighting emitted from said light sources through said prism accommodation holes.

3. The button as defined in claim 1, wherein a number of said prisms is consistent with a number of the markings of said manipulation case, and said prisms comprise first, second and third elements positioned at said prism accommodation holes of said accommodation housing, respectively.

4. The button as defined in claim 1, wherein said light sources comprise a Light-Emitting Diode (LED) that emits light in colors corresponding to the markings of said manipulation case.

* * * * *